US005506591A

United States Patent [19]

Dienes

[11] Patent Number: 5,506,591

[45] Date of Patent: Apr. 9, 1996

[54] TELEVISION BROADCAST ANTENNA FOR BROADCASTING ELLIPTICALLY POLARIZED SIGNALS

[75] Inventor: Geza Dienes, Claremont, Calif.

[73] Assignee: Andrew Corporation, Orland Park, Ill.

[21] Appl. No.: 344,964

[22] Filed: Nov. 25, 1994

Related U.S. Application Data

[63] Continuation of Ser. No. 86,226, Jul. 1, 1993, abandoned, which is a continuation of Ser. No. 915,782, Jul. 16, 1992, abandoned, which is a continuation of Ser. No. 559,178, Jul. 30, 1990, abandoned.

[51] Int. Cl.[6] ..... H01Q 19/00

[52] U.S. Cl. ..... 343/792; 343/817; 343/818; 343/833

[58] Field of Search ..... 343/792, 810, 343/817, 818, 819, 827, 890–892, 833, 797, 798, 813, 815; H01Q 21/12, 21/24, 15/24, 19/00

[56] References Cited

U.S. PATENT DOCUMENTS

| | | | |
|---|---|---|---|
| 2,425,336 | 8/1947 | Mueller | 343/756 |
| 2,518,933 | 8/1950 | Redheffer | 343/756 |
| 2,726,389 | 12/1955 | Taylor | 343/818 |
| 2,871,477 | 1/1959 | Hatkin | 343/756 |
| 2,912,693 | 11/1959 | Lucanera et al. | 343/761 |
| 2,934,762 | 4/1960 | Smedes | 343/756 |
| 2,979,719 | 4/1961 | Avery et al. | 343/761 |
| 3,054,107 | 9/1962 | Engel et al. | 343/761 |
| 3,331,074 | 7/1967 | Chatelain | 343/756 |
| 3,587,108 | 6/1971 | Bogner | 343/833 |
| 3,656,166 | 4/1972 | Klopach et al. | 343/756 |
| 3,790,943 | 2/1974 | Pickles et al. | 343/833 |
| 4,583,098 | 4/1986 | Sikina, Jr. | 343/771 |
| 4,864,320 | 9/1989 | Munson et al. | 343/833 |
| 4,899,165 | 2/1990 | Schadler | 343/767 |

*Primary Examiner*—Michael C. Wimer
*Attorney, Agent, or Firm*—Arnold, White & Durkee

[57] ABSTRACT

A television broadcast invention comprising an elongated vertical support, a plurality of transmission lines extending upwardly along the vertical support, a plurality of primary radiators spaced along the length of the vertical support and connected to the transmission lines for radiating vertically polarized signals, and a plurality of parasitic radiating elements disposed radially outwardly from the primary radiators for re-radiating the vertically polarized signals as elliptically polarized signals. The primary radiators are preferably open-sleeve dipoles mounted on and surrounding a central hollow mast and fed by transmission lines extending along the hollow interior of the mast.

2 Claims, 8 Drawing Sheets

TELEVISION BROADCAST ANTENNA FOR BROADCASTING ELLIPTICALLY POLARIZED SIGNALS

This application is a continuation of application Ser. No. 08/086,226, filed Jul. 1, 1993 now abandoned, which is a continuation of application Ser. No. 07/915,782, filed Jul. 16, 1992 now abandoned, which is a continuation of application Ser. No. 07/559,178, filed Jul. 30, 1990, now abandoned.

FIELD OF THE INVENTION

The present invention relates generally to television broadcast antennas and, more particularly, to antennas which are capable of broadcasting elliptically polarized television signals within the VHF frequency range, and particularly at the frequencies of the lowest channels in the VHF range.

BACKGROUND OF THE INVENTION

Television broadcast antennas typically radiate horizontally polarized signals. When an elliptically polarized signal is desired, the horizontally polarized signal is modified or supplemented to generate a vertically polarized signal component which, when combined with the horizontally polarized signal, results in an elliptically polarized signal. One form of elliptical polarization is circular polarization. Antennas which operate in this manner are generally satisfactory for use in the UHF frequency range where the wavelength of the translated signal is relatively small. Such antennas become impractical, however, at the lower frequencies and longer wavelengths of the VHF frequency range, and particularly at the frequencies of the lower channels in the VHF range. The problem presented by such antennas at these lower frequencies is that the horizontal dimensions of the antenna must be increased as the wavelength increases, and this increased horizontal dimension of the antenna results in excessive windloading. In most television broadcast installations, an antenna which has a high windload requires expensive load-bearing structures and, therefore, is often unacceptable for economic reasons.

SUMMARY OF THE INVENTION

It is a primary object of the present invention to provide an improved television broadcast invention which radiates elliptically polarized signals in any desired frequency range, including the lowest channels in the VHF range, while providing a relatively small horizontal dimension and corresponding low windload.

It is another object of this invention to provide such an improved television broadcast invention that is simple to fabricate and which is readily adjustable to alter the axial ratio (the ratio of the major axis to the minor axis of the ellipse) and/or the amplitude of the elliptically polarized signal, as well as the band width. In this connection, a related object of the invention is to provide such an antenna which permits independent control of the axial ratio and amplitude of the radiated signal.

A further object of the invention is to provide such an improved television broadcast antenna which is capable of producing good omni-directional patterns, or if desired, "squaroid" patterns which are symmetrical about the axis of the antenna but with extra field strength in four segments spaced at 90-degree intervals around the axis.

Other objects and advantages of the invention will become apparent from the following detailed description and the accompanying drawings.

In accordance with the present invention, the foregoing objectives are realized by providing a television broadcast invention comprising an elongated vertical support, a plurality of transmission lines extending upwardly along the vertical support, a plurality of primary radiating means spaced along the length of the vertical support and connected to the transmission lines for radiating vertically polarized signals, and a plurality of parasitic radiating elements disposed radially outwardly from the primary radiators for re-radiating the vertically polarized signals as elliptically polarized signals. In a preferred embodiment of the invention, the primary radiators are open-sleeve dipoles mounted on and surrounding a central hollow mast and fed by transmission lines extending along the hollow interior of the mast.

DESCRIPTION OF THE PREFERRED EMBODIMENTS

Figure 1:
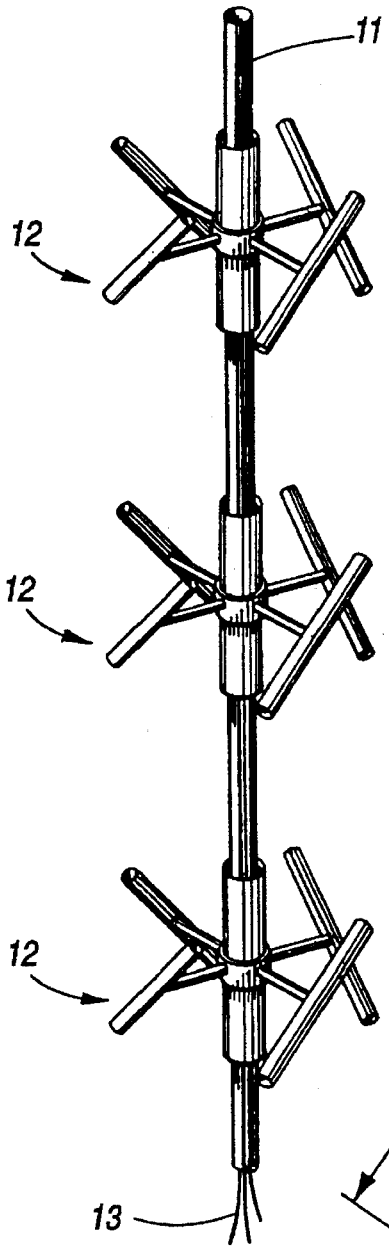
FIG. 1 is a perspective view of a portion of a television broadcast antenna embodying the present invention.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents and alternatives falling within the spirit and scope of the invention as defined by the appended claims.

Turning now to the drawings and referring first to FIG. 1, a television broadcast antenna includes a central supporting mast 11 in the form of a metal tube having sufficient diameter and wall thickness to support the entire antenna structure. Along the length of the mast 11 are multiple radiating bays 12, three of which are illustrated in FIG. 1. Each radiating bay is fed by a separate transmission line 13, preferably a coaxial cable, which extends upwardly through the hollow interior of the mast 11.

Figure 3:
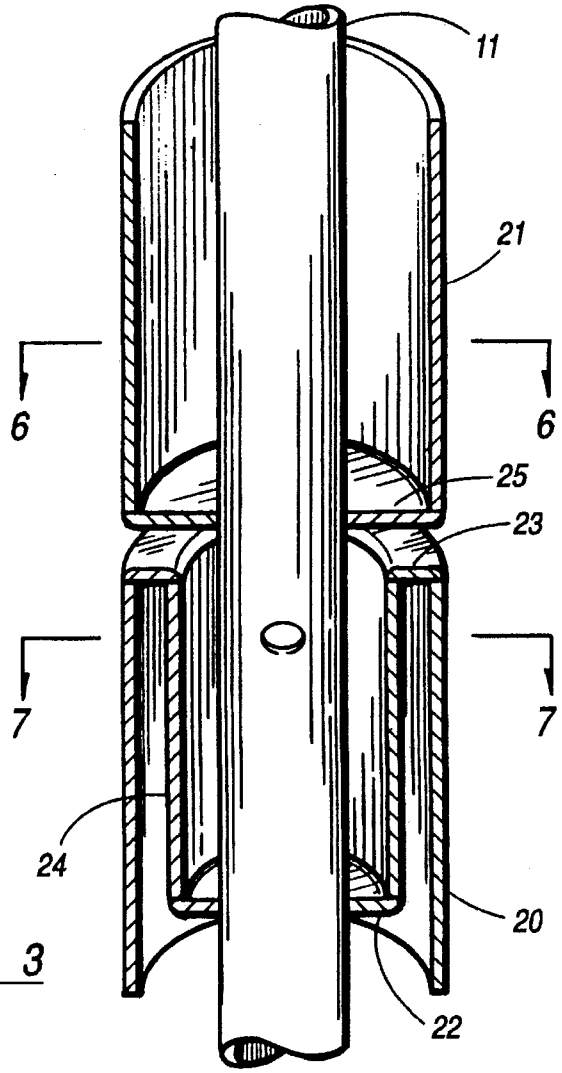
FIG. 3 is a vertical section taken approximately through the center of the vertical dipole portion of the radiation bay of FIG. 2.
Figure 7:
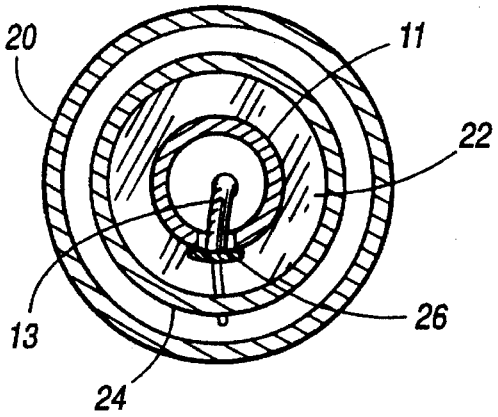
FIG. 7 is a section taken generally along line 7—7 in FIG. 3.
Figure 8:
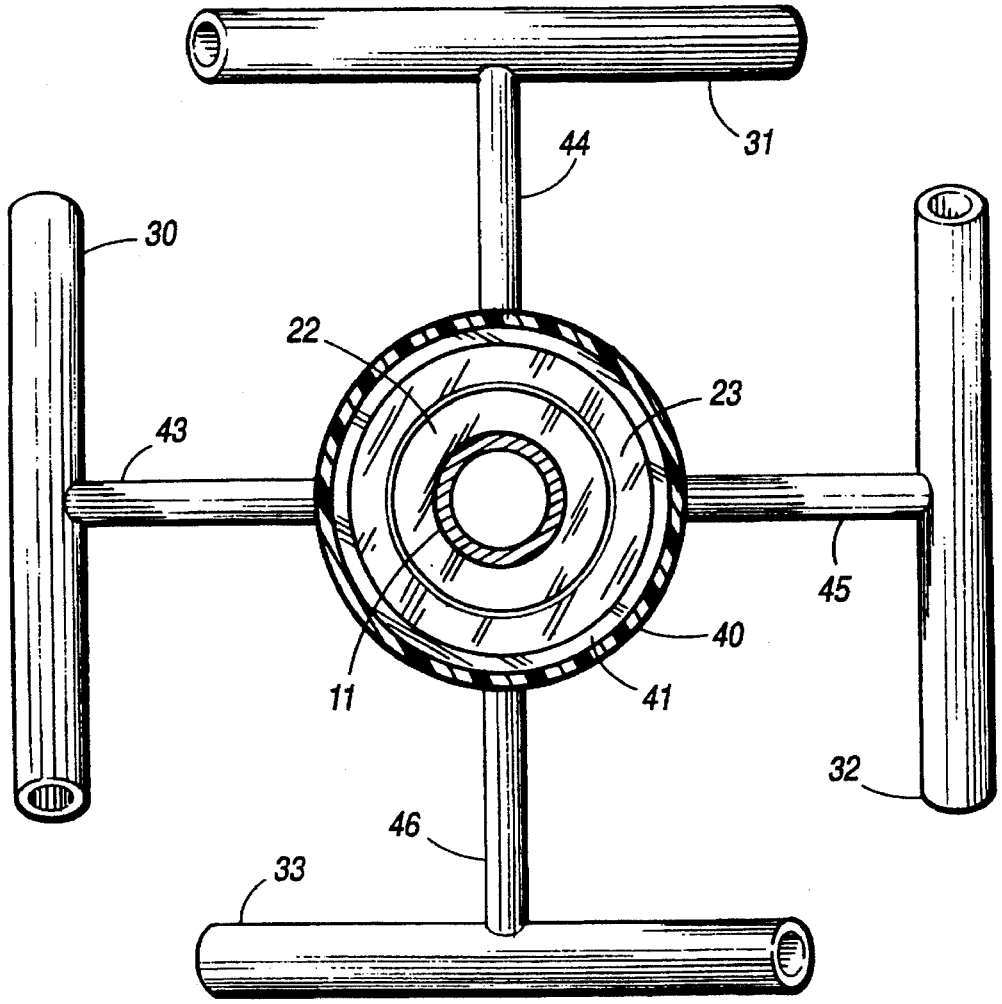
FIG. 8 is a section taken generally along line 8—8 in FIG. 5.

For the purpose of radiating vertically polarized signals, each of the radiating bays 12 includes a vertical dipole. In the particular embodiment illustrated, the vertical dipole is in the form of an open-sleeve dipole mounted on the outside surface of the mast 11. More specifically, each dipole comprises a pair of sleeves 20 and 21 surrounding the outer surface of the mast 11 and spaced apart from each other in the axial direction. The lower sleeve 20 is mounted on the mast by means of a pair of annular plates 22 and 23 connected to opposite ends of an inner sleeve 24. As can be seen most clearly in FIG. 3, the annular plate 22 extends from the lower end of the sleeve 24 to the outer surface of the mast 11, while the annular plate 23 connects the upper ends of the two sleeves 24 and 20. The coaxial cable 13 which feeds this particular dipole is connected to the lower half of the dipole by electrically connecting the inner and outer conductors of the cable 13 to the sleeve 24 and the mast 11, respectively. As can be seen in FIG. 7, the coaxial cable 13 passes upwardly through the interior of the mast 11, and is then bent radially outwardly through a hole in the mast for connection to the sleeve 24. The cable is held firmly in place by means of a fitting 26 on the outer surface of the mast.

The upper sleeve 21 of the radiating dipole is mounted on the mast 11 by means of an annular metal plate 25. Although this upper sleeve 21 is not physically connected to the coaxial cable which serves as the feed element for the dipole, it is well known in the art that both the lower sleeve 20 and the upper sleeve 21 are excited by the physical connection between the feed line and the lower sleeve of the dipole. It will be noted that the lower sleeve 20 is open at its lower end, while the upper sleeve 21 is open at its upper end, which is desirable to obtain the desired radiation pattern from the dipole.

Figure 4:
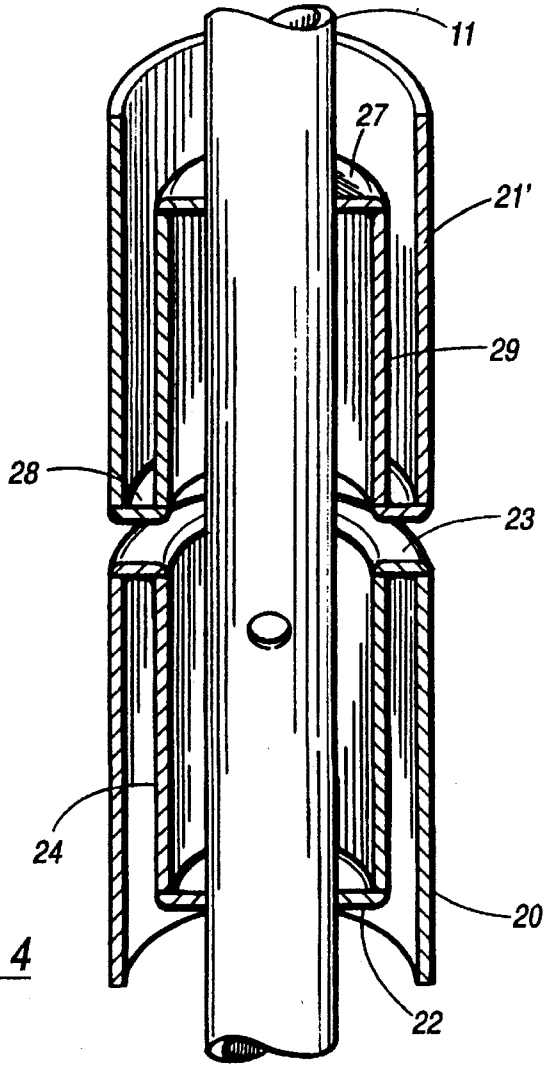
FIG. 4 is a vertical section similar to FIG. 3 but illustrating a modified dipole structure.

FIG. 4 illustrates a modified dipole structure in which the lower sleeve 20 of the dipole is the same as that described above in connection with FIG. 3. The upper sleeve 21' in the modified embodiment of FIG. 4 differs from the upper sleeve 21 in FIG. 3 in that sleeve 21' is supported in the same manner as the lower sleeve 20. Specifically, the upper sleeve 21' is mounted on the mast 11 by means of a pair of annular plates 27 and 28 connected to opposite ends of an inner sleeve 29. The annular plate 27 extends from the upper end of the sleeve 29 to the outer surface of the mast 11, while the annular plate 28 connects the lower ends of the two sleeves 29 and 21'.

Although the open-sleeve dipole is preferred because of its structural stability, it will be understood that the invention could be implemented with other types of dipoles such as folded dipoles or dipoles formed from straight metal rods.

Figure 2:
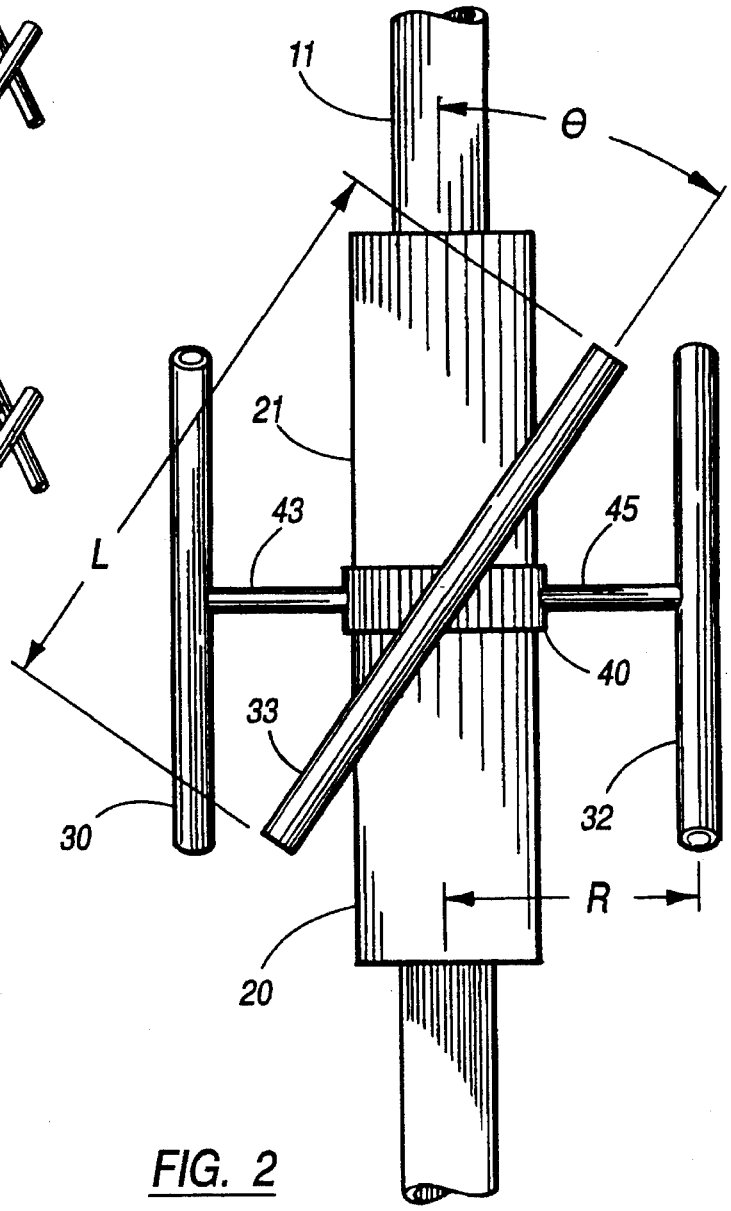
FIG. 2 is an enlarged side elevation of one of the radiating bays in the antenna of FIG. 1.

In order to convert the vertically polarized signals radiated by the open-sleeve dipole to the desired elliptically polarized signals, four parasitic radiating elements 30–33 are mounted radially outwardly from the dipole. As the television signals are radiated from the dipole with vertical polarization, that energy is re-radiated by the parasitic elements 30–33 as elliptically polarized signals. The four parasitic elements are preferably spaced at equal intervals around the circumference of the dipole, at a radius R (FIG. 2) from the vertical axis of the mast 11. Each parasitic radiator 30–33 is formed by a hollow conductive metal tube having a length L (FIG. 2) and tilted at an acute angle θ (FIG. 2) relative to a vertical axis passing through the center of each respective element. Each parasitic radiator 30–33 is perpendicular to a radial line extending from the vertical axis of the mast to the center of the parasitic radiator.

By initially launching a vertically polarized signals, and using parasitic elements to re-radiate that signal with the desired elliptical polarization, this invention significantly reduces the size of the antenna in the horizontal direction and thereby reduces the windload. This size reduction is particularly significant at the lower frequency bands with the VHF range, such as the bands commonly referred to as "Channel 2" though "Channel 7". At these frequencies the antenna structure required to launch a horizontally polarized signal has a horizontal dimension, and thus a windload, several times as large as that required to launch a vertically polarized signal.

Although the invention has been illustrated with four parasitic radiators in each bay, the number of parasitic radiators utilized may vary widely. Most commonly, however, the number of parasitic radiators in each bay will be 3, 4 or 5, usually spaced at equal intervals around the circumference of the bay.

Figure 5:
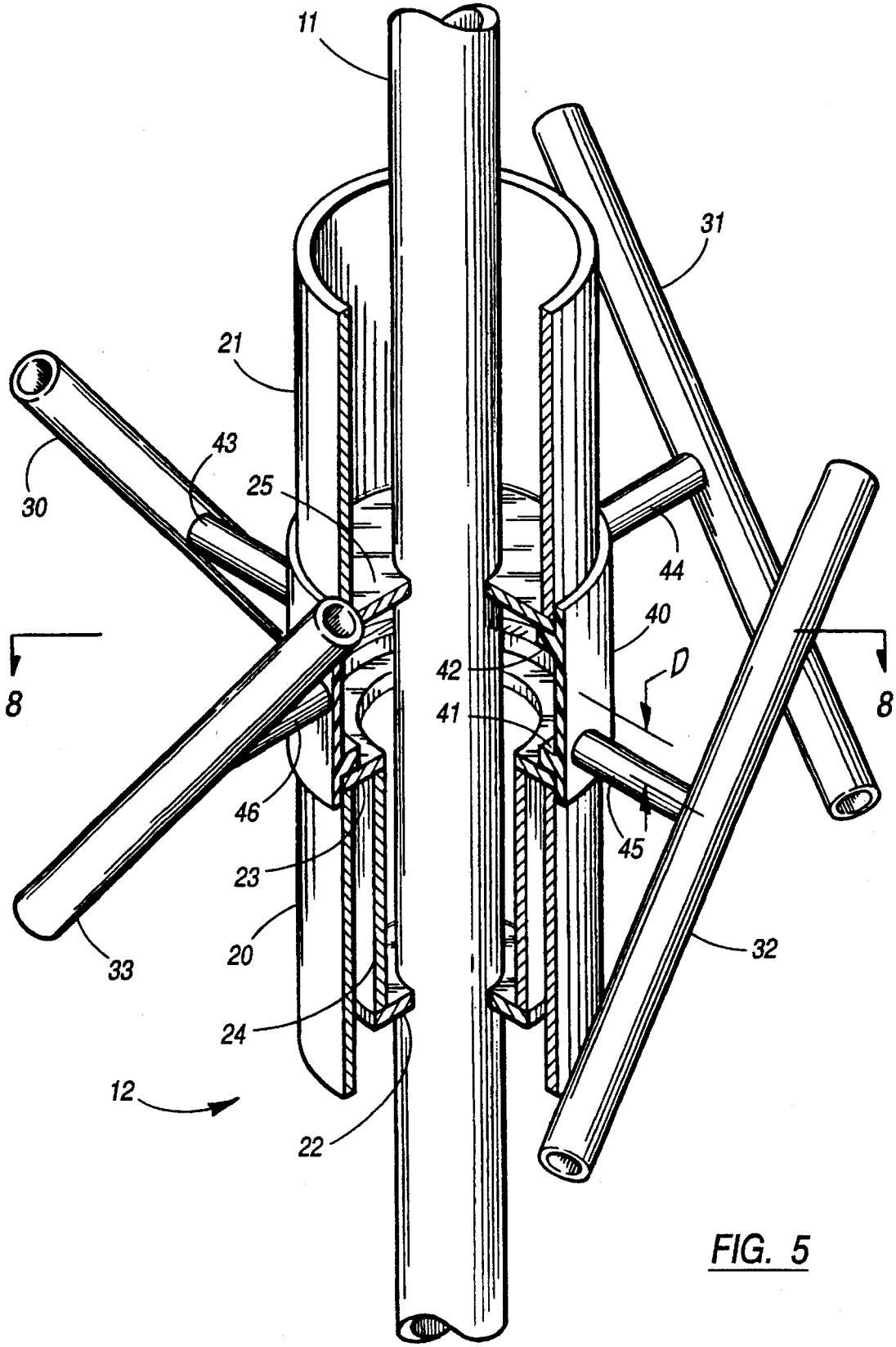
FIG. 5 is an enlarged perspective view, partially in section, of the radiating bay shown in FIG. 2.
Figure 6:
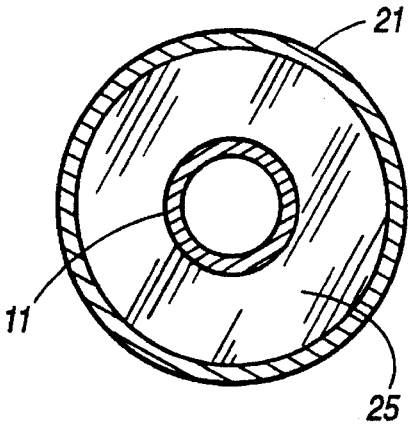
FIG. 6 is a section taken generally along line 6—6 in FIG. 3.

The magnitude of the signal re-radiated by the parasitic radiators depends on the level of coupling between the open-sleeve dipole and the parasitic radiators. The level of coupling, in turn, depends on the radius R between the vertical axis of the vertical dipole and the parasitic radiators, the angle θ the impedance of the parasitic elements, and the axial distance D (FIG. 5) between the centers of the dipole and the parasitic elements.

The phase relationship between the vertically polarized and horizontally polarized components of the elliptically polarized signal is preferably controlled by adjusting the length L of the parasitic elements. The impedance of each parasitic element is a function of its length L, and thus the length L also has an effect on the level of coupling between the dipole and the parasitic elements. If it is desired to maintain the level of coupling constant while changing L to change the phase relationship, one of the other parameters mentioned above may be altered to offset the impedance change caused by the change in L. The axial ratio of the amplitudes of the vertically and horizontally components of the elliptically polarized signal is preferably controlled by adjusting the angle θ and/or the distance D.

The band width of the illustrative antenna is dependent primarily on the radius R, the cross section of each parasitic element, and the number of parasitic elements used. For example, it has been shown that a single radiating bay having one open-sleeve dipole exciting four parasitic elements located on a radius R of 0.22λ and having a tilt angle θ of 35.5°, a length L of 0.47λand a diameter of 0.002λ, a better than 2-dB axial ratio band width of 10% is obtained.

To support the parasitic radiators, a dielectric sleeve 40 is mounted in the space between the two sleeves of the dipole. The sleeve 40 is held in place by two inwardly extending flanges 41 and 42 which extend along the opposed surfaces of the two annular plates 23 and 25. The sleeve 40 supports four radial dielectric rods 43–46 which carry the four parasitic radiators 30–33. The inner ends of the four dielectric rods 43–46 are anchored in the sleeve 40, and the rods extend outwardly therefrom to support the parasitic radiators 30–33 in the desired positions.

Figure 9:
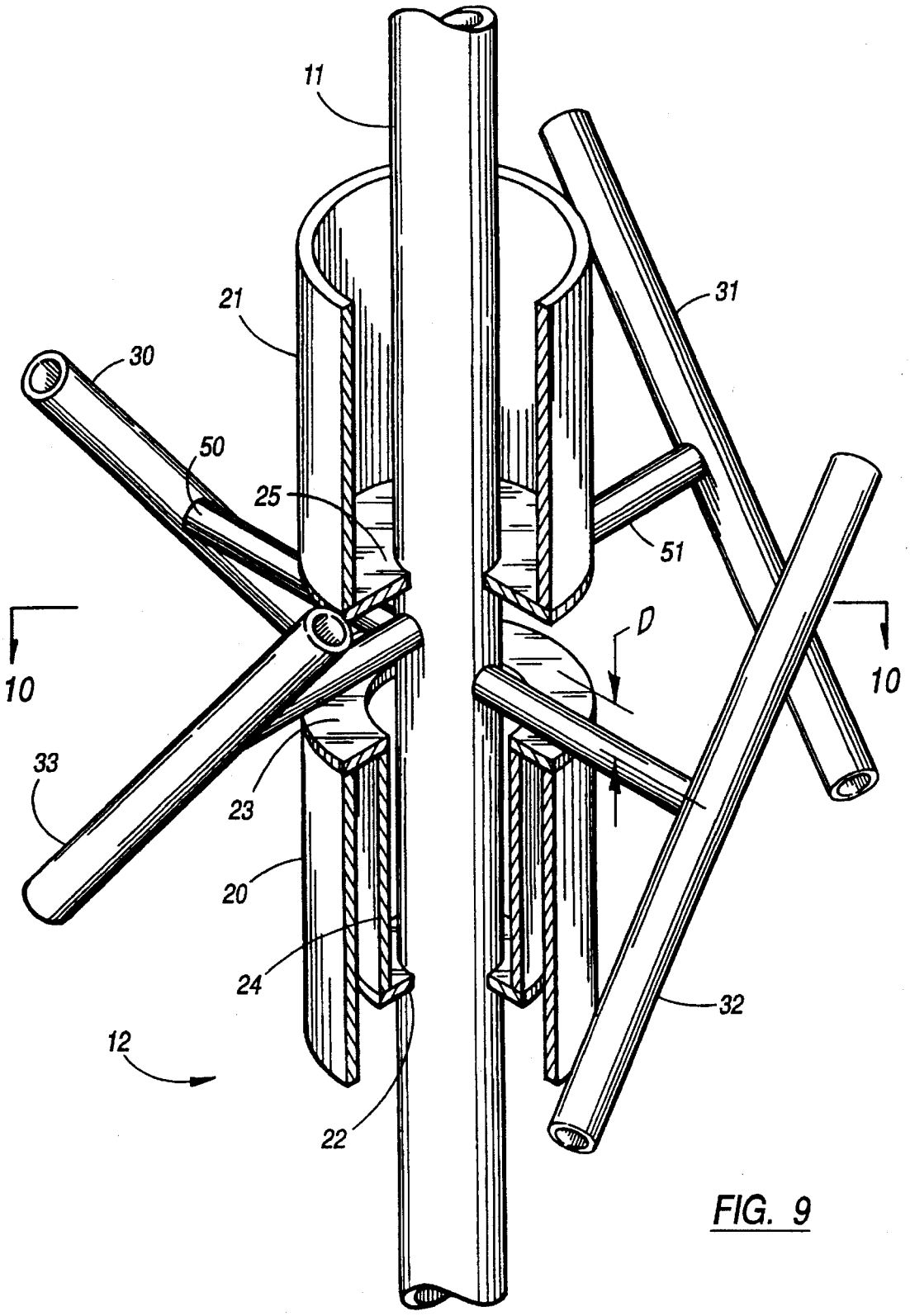
FIG. 9 is a perspective view similar to FIG. 5 but showing a modified structure.
Figure 10:
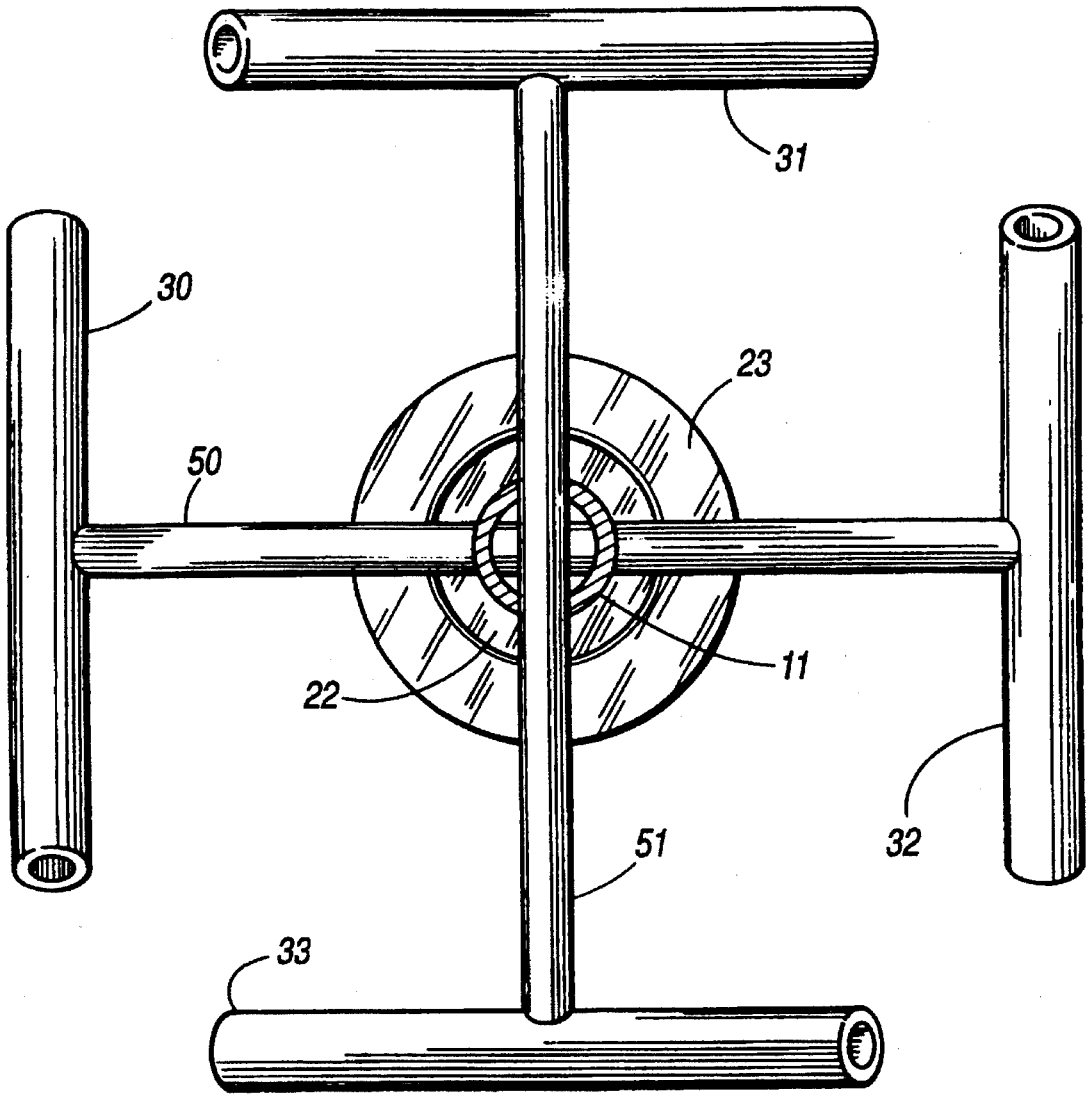
FIG. 10 is a section taken generally along line 10—10 in FIG. 9.

In a modified embodiment of the invention illustrated in FIGS. 9 and 10, the parasitic radiators are supported by a different mounting arrangement which utilizes only two dielectric rods 50 and 51. Both of these dielectric rods 50 and 51 extend diametrically through the mast 11 along perpendicular axes. The rod 50 carries the two diametrically opposed parasitic radiators 30 and 32, while the rod 51 carries the other two radiators 31 and 33. To enable the two rods 50 and 51 to pass each other within the mast 11, the rods are slightly offset from each other in the vertical direction. To keep all four radiators aligned with the center of the dipole, the rod 50 is connected to the two parasitic radiators 30 and 32 slightly below the centers of those radiators, and the rod 51 is connected to the two radiators 31 and 33 slightly above the centers of those radiators.

The antenna of this invention is capable of producing good omni-directional patterns by the simple expedient of alternating the locations of the parasitic elements for every other bay by 45° in azimuth. Alternatively, the antenna may be used to produce "squaroid" patterns which provide extra field strength in four angular segments spaced at 90° intervals around the circumference of the antenna.

Figure 11:
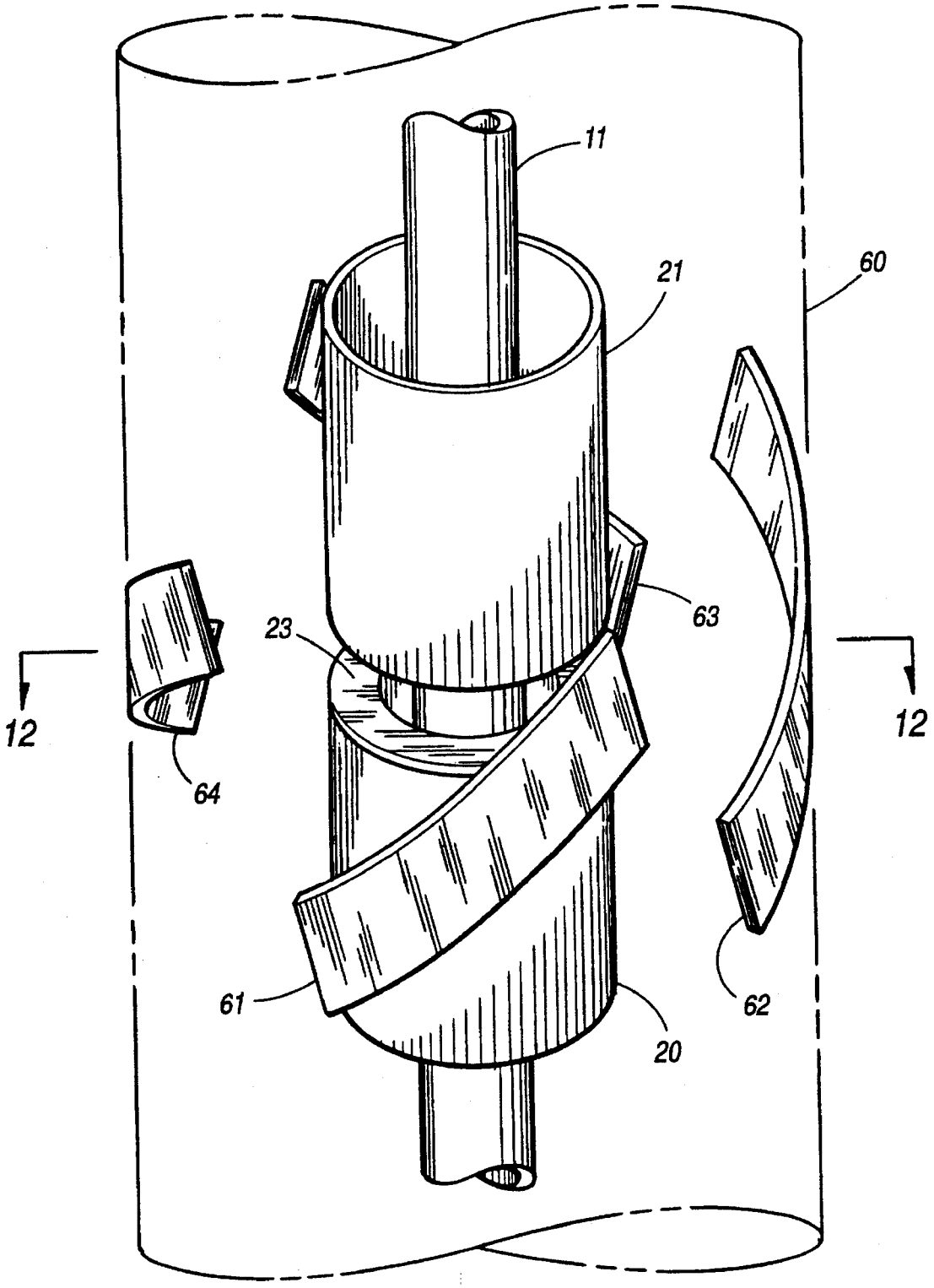
FIG. 11 is a side elevation of a modified embodiment of a television broadcast antenna embodying the present invention, with the radome portion of the antenna shown in phantom lines.
Figure 12:
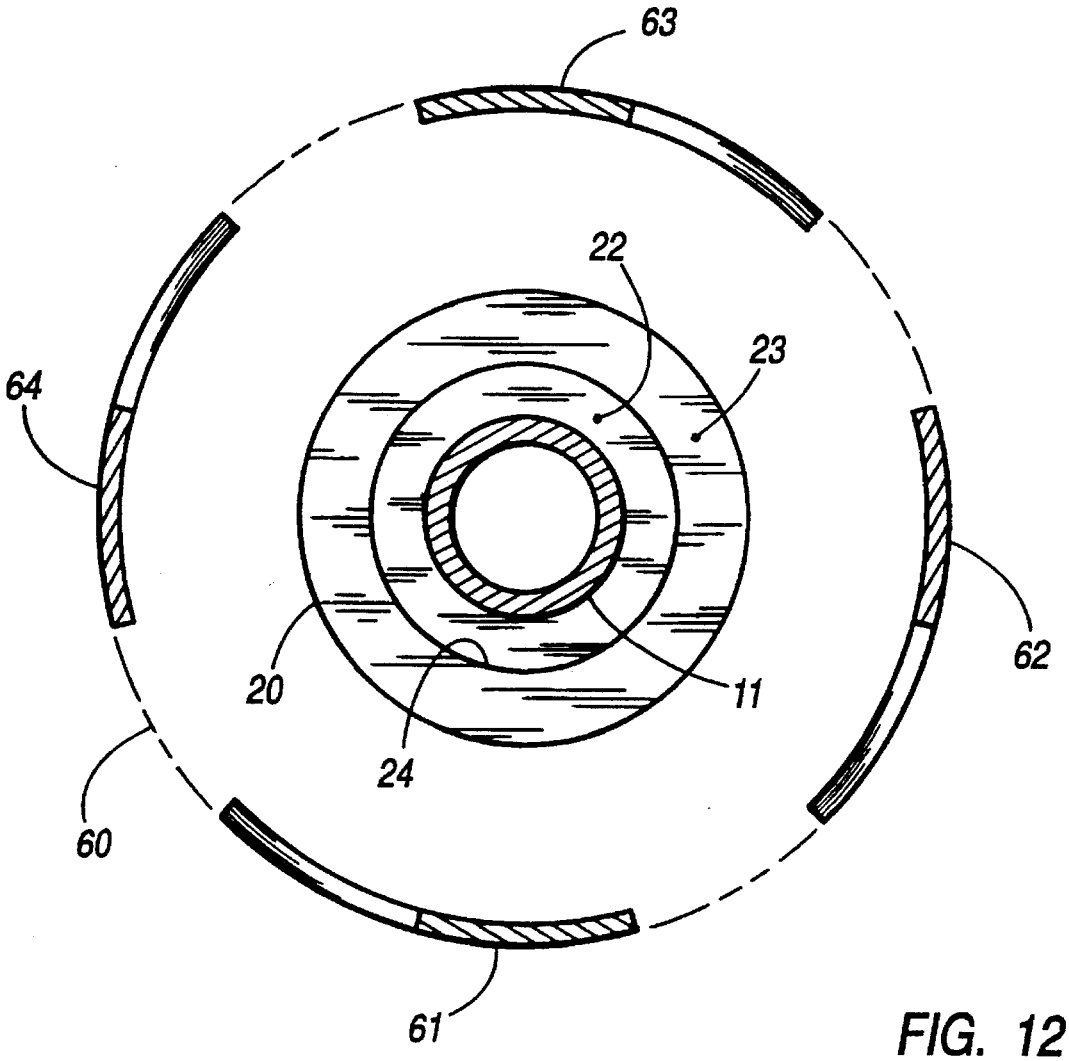
FIG. 12 is a vertical section taken generally along the line 12—12 in FIG. 11.

In another modified embodiment of the invention illustrated in FIGS. 11 and 12, the parasitic radiators are supported on the inside surface of the cylindrical radome 60 which surrounds the antenna. The parasitic radiators 61–64 are in the form of flat conductive strips which are not only tilted but also curved to follow the curvature of the inside surface of the cylindrical radome 60. The radome 60 is typically made of a non-conductive material, and thus the parasitic radiator 61–64 may be simply bonded to the interior surface of the radome. This arrangement avoids the need for supporting rods to attach the parasitic radiators to the mast, and further reduces the windload of the antenna by reducing its diameter. The latter advantage is particularly useful for broadcasting television signals in the lower frequency ranges.

I claim:

1. A television broadcast antenna for broadcasting elliptically polarized signals, said antenna comprising:

an elongated vertical mast extending along a generally vertical axis;

at least one transmission line extending upwardly along said vertical mast;

a primary radiator mounted to said vertical mast and connected to said transmission line, said primary radiator radiating vertically polarized signals;

a plurality of dielectric supporting rods extending radially outwardly from said vertical mast, said dielectric supporting rods being generally perpendicular to said vertical axis, each of said plurality of dielectric rods having a radially inner end and a radially outer end, said radially inner end being disposed in closed proximity to said primary radiator; and a plurality of generally straight parasitic elements spaced radially from said primary radiator and mounted to said respective dielectric supporting rods at said respective radially outer ends thereof, said plurality of parasitic elements being generally perpendicular to said respective dielectric supporting rods and being tilted relative to said vertical axis, said parasitic elements being circumferentially spaced at substantially equal intervals about said vertical axis, said parasitic elements not conducively connected to said vertical mast, said primary radiator, and said transmission line, said parasitic elements reradiating a portion of said vertically polarized signals as horizontally polarized signals so as to generate elliptically polarized signals.

2. A television broadcast antenna for broadcasting elliptically polarized signals, said antenna comprising:

an elongated hollow vertical mast extending along a generally vertical axis;

a plurality of primary radiators in the form of open-sleeve vertical dipoles mounted to an outer surface of said vertical mast, said open-sleeve dipoles being spaced along the length of said vertical mast, each of said open-sleeve dipoles including an upper sleeve and a lower sleeve, said open-sleeve dipoles radiating vertically polarized signals;

a plurality of dielectric sleeves associated with respective ones of said open-sleeve dipoles, each of said dielectric sleeves being mounted in a space between said upper sleeve and said lower sleeve of a respective one of said open-sleeve dipoles;

a plurality of transmission lines in the form of coaxial cables extending upwardly through said vertical mast and connected to respective ones of said open-sleeve dipoles;

a plurality of dielectric supporting rods connected to each of said dielectric sleeves an extending radially outwardly from said vertical mast, said dielectric supporting rods being generally perpendicular to said vertical axis, each of said plurality of dielectric rods having a radially inner end and a radially outer end, said radially inner end being anchored in a respective one of said dielectric sleeves; and three to five generally straight parasitic elements in the form of hollow conductive rods spaced radially from each of said open-sleeve dipoles, said parasitic elements having respective center portions mounted to said radially outer ends of respective said dielectric supporting rods, said plurality of parasitic elements being generally perpendicular to respective said dielectric supporting rods and being tilted at an acute angle relative to said vertical axis, said parasitic elements being circumferentially spaced at substantially equal intervals about said vertical axis such that each of said parasitic elements occupies circumferential angles about said vertical axis which do not overlap with circumferential angles occupied by adjacent ones of said parasitic elements, said parasitic elements not conducively connected to said vertical mast, said open-sleeve dipoles, and said transmission lines, said parasitic elements being fixed relative to said vertical mast, said parasitic elements reradiating a portion of said vertically polarized signals as horizontally polarized signals so as to generate elliptically polarized signals.

* * * * *